US011976662B2

(12) United States Patent
Cobbett et al.

(10) Patent No.: US 11,976,662 B2
(45) Date of Patent: May 7, 2024

(54) VACUUM CHAMBER MODULE

(71) Applicant: Edwards Limited, West Sussex (GB)

(72) Inventors: Andrew Cobbett, Burgess Hill (GB); Richard Glyn Horler, Burgess Hill (GB)

(73) Assignee: Edwards Limited, West Sussex (GB)

( * ) Notice: Subject to any disclaimer, the term of this patent is extended or adjusted under 35 U.S.C. 154(b) by 274 days.

(21) Appl. No.: 17/602,117

(22) PCT Filed: Apr. 9, 2020

(86) PCT No.: PCT/GB2020/050943
§ 371 (c)(1),
(2) Date: Oct. 7, 2021

(87) PCT Pub. No.: WO2020/208375
PCT Pub. Date: Oct. 15, 2020

(65) Prior Publication Data

US 2022/0364569 A1 Nov. 17, 2022

(30) Foreign Application Priority Data

Apr. 11, 2019 (GB) ..... 1905122.6

(51) Int. Cl.
*F04D 19/04* (2006.01)
*F04D 29/40* (2006.01)
*F04D 29/60* (2006.01)

(52) U.S. Cl.
CPC ..... *F04D 19/042* (2013.01); *F04D 29/40* (2013.01); *F04D 29/602* (2013.01)

(58) Field of Classification Search
CPC ..... F04D 19/042; F04D 29/40; F04D 29/602
See application file for complete search history.

(56) References Cited

U.S. PATENT DOCUMENTS 3,628,894 A * 12/1971 Ferguson, Jr. ..... F04D 19/04 417/353
5,733,104 A * 3/1998 Conrad ..... F04D 25/00 417/423.4

(Continued)

FOREIGN PATENT DOCUMENTS

CA 2563248 A1 * 12/2001
EP 1085214 A2 3/2001

(Continued)

OTHER PUBLICATIONS

British Examination Report dated Oct. 8, 2019 and Search Report dated Aug. 7, 2019 for corresponding British Application No. GB1905122.6, 6 pages.

(Continued)

*Primary Examiner* — Nathan C Zollinger
(74) *Attorney, Agent, or Firm* — Theodore M. Magee; Westman, Champlin & Koehler, P.A.

(57) ABSTRACT

A vacuum chamber module and an apparatus are disclosed. The vacuum chamber module comprises: a pump wall defining a recess shaped to receive a multi-stage vacuum pump; a plurality of vacuum chambers, each vacuum chamber being configured to be pumped by a respective stage of the multi-stage vacuum pump, each vacuum chamber being defined at least partially by a portion of the pump wall, each vacuum chamber having an pumping port located at a different circumferential position on the pump wall for fluid communication with the respective stage of the multi-stage vacuum pump. In this way, a module is provided which shares components, with the multi-stage pump at least partially accommodated within space otherwise occupied by the vacuum chambers and with the vacuum chambers located around the pump wall, which provides for a simpler and more compact arrangement.

13 Claims, 7 Drawing Sheets

(56) References Cited

U.S. PATENT DOCUMENTS

| | | | | |
|---|---|---|---|---|
| 6,193,461 | B1 * | 2/2001 | Hablanian | F04F 9/00 415/199.5 |
| 8,070,418 | B2 * | 12/2011 | Zipp | F04D 29/4213 415/90 |
| 8,235,678 | B2 * | 8/2012 | Stones | F04D 19/044 417/205 |
| 2005/0147509 | A1 * | 7/2005 | Bailey | H01L 21/67017 417/423.4 |
| 2007/0258836 | A1 * | 11/2007 | Hofmann | F04D 19/042 417/423.4 |
| 2010/0187415 | A1 * | 7/2010 | Schneiders | F04D 19/042 415/199.5 |
| 2018/0163732 | A1 | 6/2018 | Cobbett et al. | |

FOREIGN PATENT DOCUMENTS

| | | | |
|---|---|---|---|
| EP | 3327293 | A1 | 5/2018 |
| WO | 2005033520 | A1 | 4/2005 |
| WO | 2016126594 | A1 | 8/2016 |

OTHER PUBLICATIONS

PCT Notification of Transmittal of the International Search Report and the Written Opinion of the International Searching Authority, or the Declaration dated Jul. 9, 2020 and PCT Search Report dated Jul. 9, 2020 for corresponding PCT Application No. PCT/GB2020/050943.

PCT Written Opinion dated Jul. 9, 2020 for corresponding PCT Application No. PCT/GB2020/050943.

* cited by examiner

VACUUM CHAMBER MODULE

CROSS-REFERENCE OF RELATED APPLICATION

This application is a Section 371 National Stage Application of International Application No. PCT/GB2020/050943, filed Apr. 9, 2020, and published as WO 2020/208375 A1 on Oct. 15, 2020, the content of which is hereby incorporated by reference in its entirety and which claims priority of British Application No. 1905122.6, filed Apr. 11, 2019.

FIELD

The field of the invention relates to a vacuum chamber module and an apparatus.

BACKGROUND

There a number of types of apparatus where a plurality of chambers or systems need to be evacuated down to different levels of vacuum. For example, in well-known types of mass spectrometer that part of the apparatus known as the detector commonly has to be operated at, say $10^{-6}$ mbar whereas that part known as the analyser has to be operated at a different level of vacuum, say $10^{-3}$ mbar. In apparatus of the type including, but not restricted to mass spectrometers, a number of different vacuum pumps are normally employed. There is an ever increasing need to rationalise the use of the various vacuum pumps for overall reduced apparatus size and power requirements. A single backing pump is relatively common for supporting two (or more) turbo-molecular pumps. In addition, it has been proposed to employ a single turbo-molecular pump to replace two (or more) individual pumps with the single pump having a normal inlet for gas required to pass through all the stages of the pump and an intermediate or interstage inlet, i.e. between the stages, for gas required to pass through only the latter stages of the pump. There is an increasing need for improved apparatus of this type.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided a vacuum chamber module, comprising: a pump wall defining a recess shaped to receive a multi-stage vacuum pump; a plurality of vacuum chambers, each vacuum chamber being configured to be pumped by a respective stage of the multi-stage vacuum pump, each vacuum chamber being defined at least partially by a portion of the pump wall, each vacuum chamber having an pumping port located at a different circumferential position on the pump wall for fluid communication with the respective stage of the multi-stage vacuum pump.

The first aspect recognizes that existing arrangements are often complex, with many separate parts, and occupy a relatively large footprint. Accordingly, a vacuum chamber module or component is provided. The vacuum chamber module may comprise a pump wall or enclosure which is shaped to form a recess or depression which can receive or accommodate at least a portion of a multi-stage vacuum pump. The module may comprise two or more vacuum chambers. The vacuum chambers may be arranged to be pumped using an associated stage of the multi-stage vacuum pump. Each of the vacuum chambers may be formed at least partially by a portion or part of the pump wall. Each vacuum chamber may have a pumping port. The pumping ports may be located at different positions around or in the pump wall to support fluid communication with the associated stage of the multi-stage vacuum pump. In this way, a module is provided which shares components, with the multi-stage pump at least partially accommodated within space otherwise occupied by the vacuum chambers and with the vacuum chambers located around the pump wall, which provides for a simpler and more compact arrangement.

In one embodiment, the interstage ports extend circumferentially along the pump wall. Accordingly, the interstage ports may be defined by apertures formed by the absence of a section of the pump wall.

In one embodiment, the interstage ports are located to be non-overlapping circumferentially along the pump wall. Hence, each interstage port may extend around its own, different, circumferential portion of the pump wall.

In one embodiment, the interstage ports are located at different positions along a longitudinal axis of the multi-stage vacuum pump. Accordingly, each interstage port may be positioned at different locations along the longitudinal axis in order to align with the appropriate stage of the multi-stage vacuum pump.

In one embodiment, the vacuum chambers extend along a common portion of the longitudinal axis. Accordingly, two or more vacuum chambers may both occupy the same portion of the longitudinal axis, which provides for a simpler and more compact arrangement.

In one embodiment, adjacent vacuum chambers share a common dividing wall extending along the common portion of the longitudinal axis. Accordingly, a single wall may be provided between, and shared by, adjacent vacuum chambers. In other words, for adjacent vacuum chambers, the two vacuum chambers may be arranged side by side, both extending along the same portion of the longitudinal axis, which provides for a simpler and more compact arrangement.

In one embodiment, the pump wall defines a pump chamber shaped to receive the multi-stage vacuum pump. Accordingly, the vacuum wall may be shaped as a pump chamber which accommodates the multi-stage vacuum pump.

In one embodiment, the pump wall surrounds the multi-stage vacuum pump. Accordingly, the pump wall may surround or enclose the multi-stage vacuum pump.

In one embodiment, the pump wall is cylindrical. Accordingly, the ports may be formed as part-cylindrical apertures.

In one embodiment, the vacuum chambers have a pair of vacuum chamber walls extending radially from the pump wall. Accordingly, at least two vacuum chambers may have walls which extend with a radial or tangential component from the pump wall.

In one embodiment, the vacuum chambers comprise a joining wall extending circumferentially and joining the pair of vacuum chamber walls. Accordingly, the vacuum chambers may have a wall extending circumferentially, between the radial walls. Again, this provides for a simple and compact arrangement.

In one embodiment, the vacuum chambers extend radially from the pump chamber and are positioned circumferentially around the pump chamber. Accordingly, the vacuum chambers may be positioned around the pump chamber. Again, this provides for a simple and compact arrangement.

In one embodiment, the vacuum chambers comprise inter-chamber apertures configured for fluid communication between the vacuum chambers.

In one embodiment, the pump wall defines a recess shaped to receive at least one further vacuum pump.

In one embodiment, each vacuum chamber has at least one pumping port located on the pump wall for fluid communication with at least one of the multi-stage vacuum pump and the at least one further vacuum pump.

According to a second aspect, there is provided an apparatus comprising: the vacuum chamber module of the first aspect and its embodiments; and a multi-stage vacuum pump.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1A:
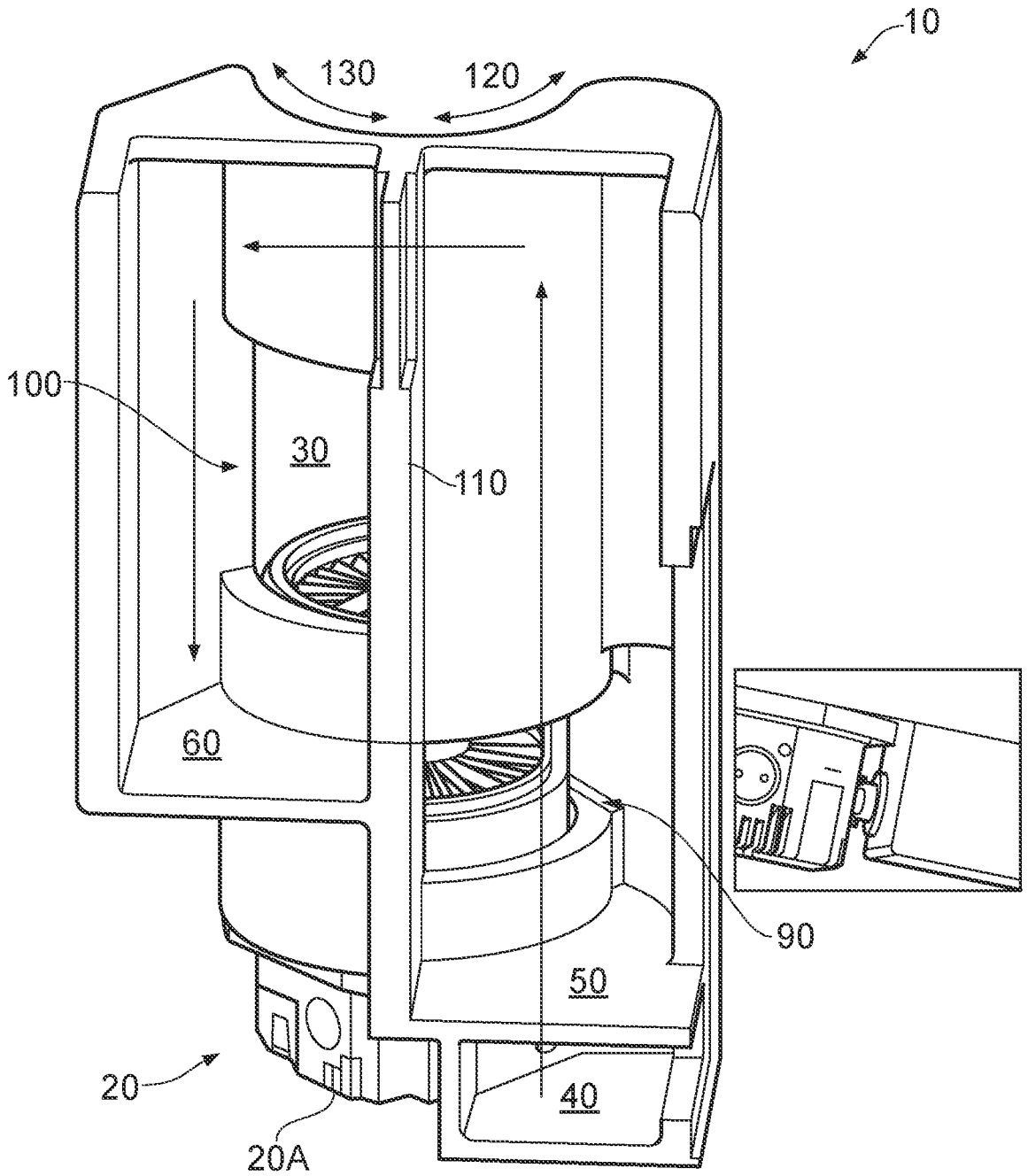
FIG. 1A is a perspective sectional view of a vacuum chamber according to one embodiment incorporating a vacuum pump.
Figure 1B:
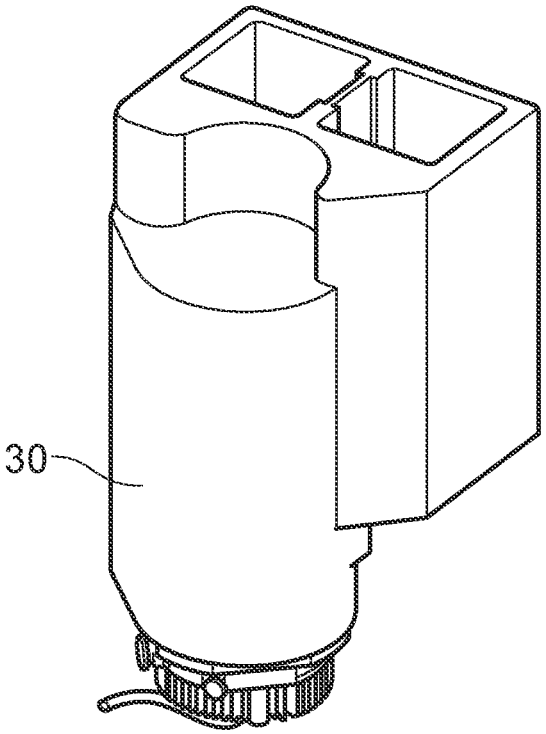
FIGS. 1B and 1C are perspective views of the vacuum chamber of FIG. 1A incorporating a vacuum pump.
Figure 1C:
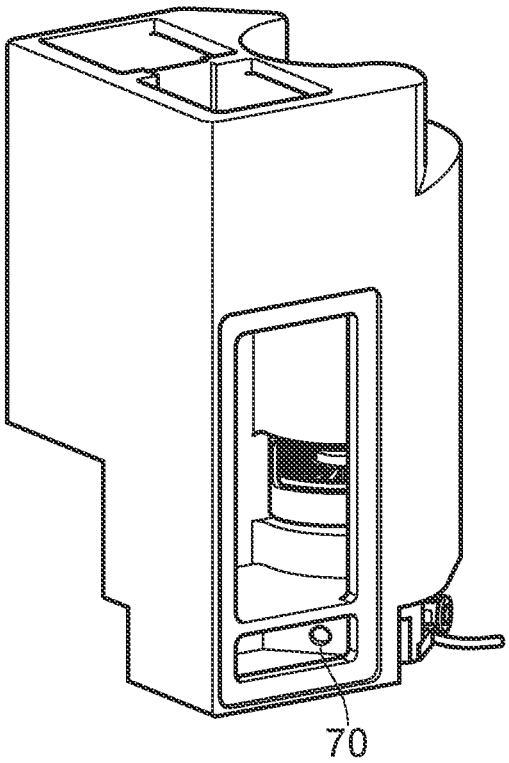
Figure 1D:
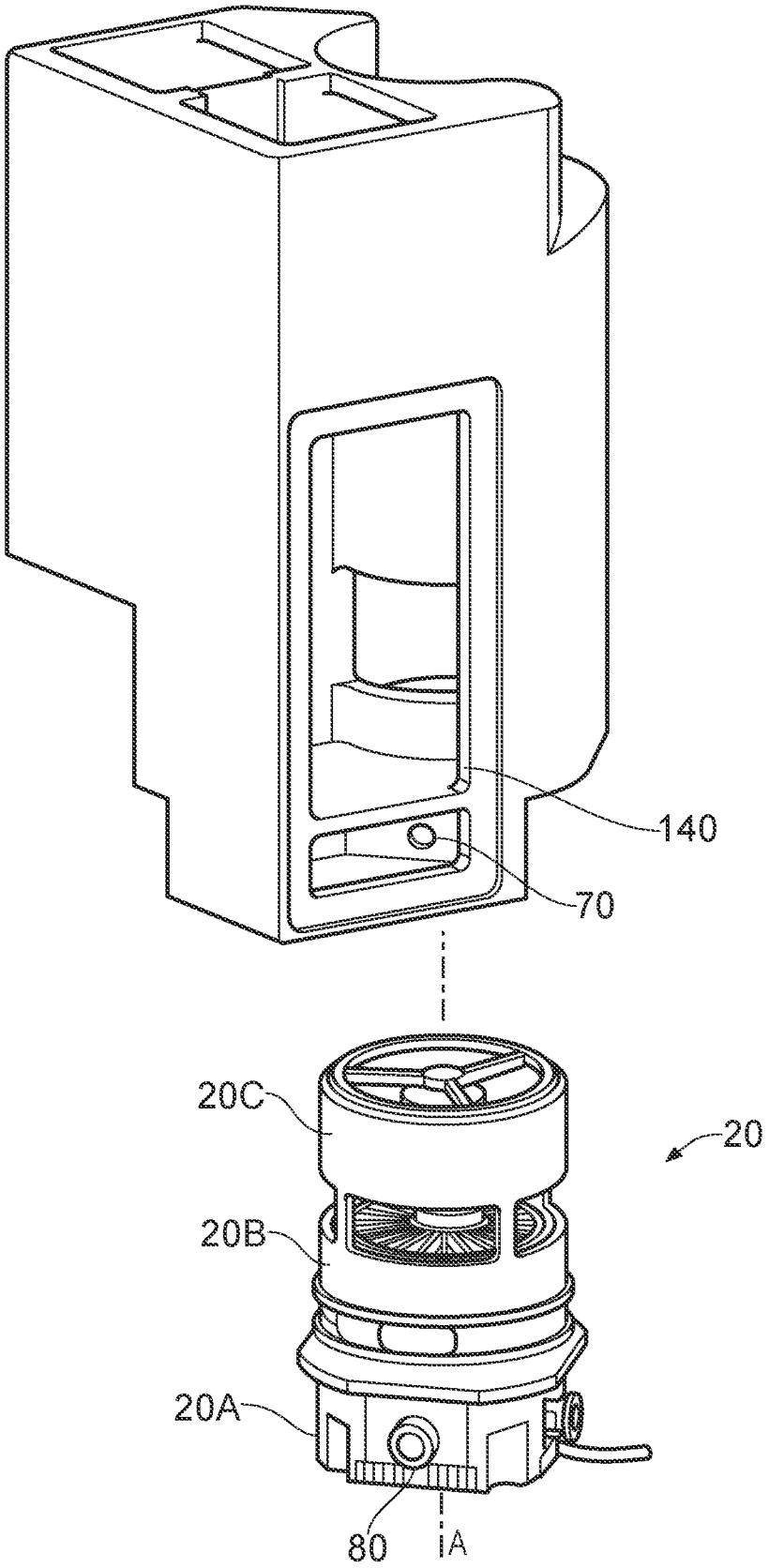
FIG. 1D is the perspective view of FIG. 1C with the vacuum pump removed.
Figure 1E:
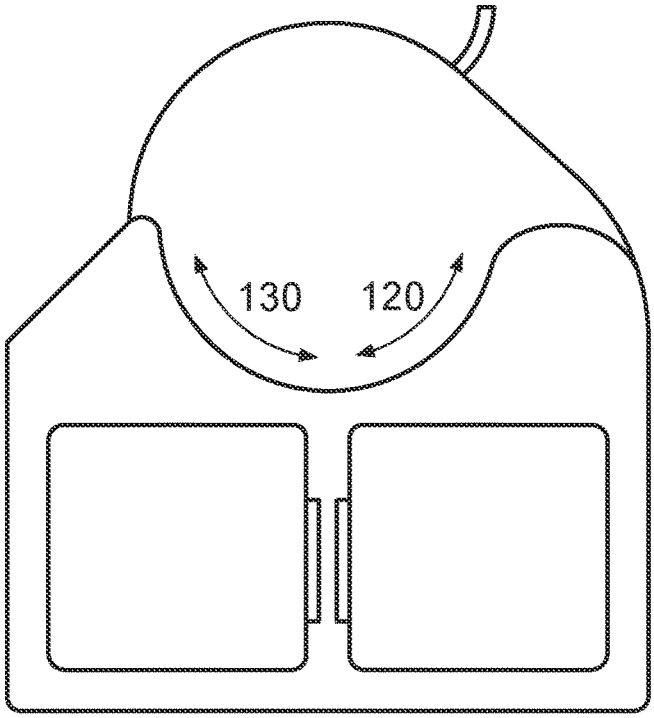
FIGS. 1E and 1F are perspective views of the vacuum chamber of FIG. 1A incorporating a vacuum pump.
Figure 1F:
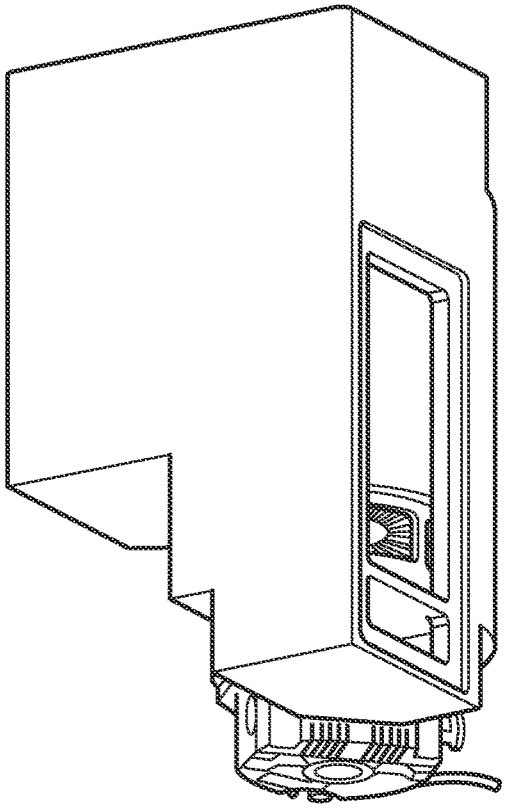

Before discussing the embodiments in any more detail, first an overview will be provided. Embodiments provide a vacuum chamber module for use with a multi-stage vacuum pump. The vacuum chamber module has a central portion, typically a generally cylindrical chamber, within which the multi-stage vacuum pump is located. A series of vacuum chambers, shaped generally as radially-extending lobes or petals, are positioned circumferentially around the central pump chamber. Ports are formed in the wall of the pump chamber to fluidly couple the vacuum chambers with the appropriate stage within the multi-stage vacuum pump. This provides for a simple and compact arrangement which allows different vacuum chambers to be operated at different pressures. In particular, each vacuum chamber can accommodate at least a portion of the footprint of the multi-stage vacuum pump, and by arranging the vacuum chambers generally side by side, extending along the longitudinal length of the multi-stage vacuum pump, the overall height of the vacuum chamber module is constrained.

Vacuum Chamber Module—1$^{st}$ Embodiment

FIGS. 1A to 1F illustrate a vacuum chamber module 10 according to one embodiment. The vacuum chamber module 10 is typically cast, then machined and is shaped to receive a vacuum pump 20. The vacuum pump 20 is a multistage vacuum pump arranged as a so-called cartridge pump. The vacuum pump 20 has a backing pump stage 20A, a first turbo molecular pump stage 20B and a second turbo molecular pump stage 20C. It will be appreciated that embodiments may have fewer or more stages and that different types of pumps may be provided at each stage. As can be seen, the backing pump stage 20A, first turbo molecular pump stage 20B and second turbo molecular pump stage 20C share a common longitudinal axis A and occupy a generally-cylindrical space.

The vacuum chamber module 10 is provided with a pump chamber 30 which is generally-cylindrical in shape to receive the vacuum pump 20. The vacuum chamber module 10 is provided with a first chamber 40, a second chamber 50 and a third chamber 60. The second chamber 50 and the third chamber 60 extend radially from the pump chamber 30 and sit side-by-side, extending along the longitudinal axis A.

The first chamber 40 has a first pumping port 70 formed in a wall of the first chamber 40 shared with the pump chamber 30. The first pumping port 70 couples with an inlet port 80 on the backing pump 20A. The second chamber 50 has a primary interstage port 90 formed in a wall of the second chamber 50 shared with the pump chamber 30. The third chamber 60 has a secondary interstage port 100 formed in a wall of the third chamber 60 shared with the pump chamber 30. Hence, it can be seen that the volume of the pump chamber extends within the volume of the first chamber 40, the second chamber 50 and the third chamber 60, which helps to provide a compact arrangement.

The second chamber 50 and the third chamber 60 extend along the longitudinal axis A. The second chamber 50 and the third chamber 60 share a common wall 110 which extends along the longitudinal axis A. Arranging the chambers next to each other, sharing space along the longitudinal axis A, helps to provide a compact arrangement. As can best be seen in FIG. 1A, the second chamber 50 and the third chamber 60 are co-located together, extending radially from different arc portions of the pump chamber 30. In particular, the second chamber 50 extends from a first arc portion 120 of the pump chamber 30 and the third chamber 60 extends from a second arc portion 130 of the pump chamber 30. The primary interstage port 90 is formed along the first arc portion 120 at a position along the longitudinal axis A which enables fluid communication between the second chamber 50 and the upstream inlet of the first turbo molecular pump stage 20B. The secondary interstage port 100 is formed along the second arc portion 130 at a position along the longitudinal axis A which enables fluid communication between the third chamber 60 and the upstream inlet of the second turbo molecular pump stage 20C. Hence, it can be seen that each port extends along a portion of the wall shared by that chamber and the pump chamber. The longitudinal position of each port is positioned to couple with the appropriate part of the vacuum pump 20.

In operation, a sealing plate (not shown) is placed over an access aperture 140 provided in the wall of the first chamber 40 and the second chamber 50. A sample (not shown) is introduced into the first chamber 40, either by placing the sample within the first chamber 40 or by introducing the sample in another way and then securing the sealing plate over the access aperture 140.

The vacuum pump 20 is activated. The first chamber 40 is evacuated by the backing pump 20A via the first pumping port 70. The second chamber 50 is evacuated by the first turbo molecular pump stage 20B and the backing pump 20A via the primary interstage port 90. The third chamber 60 is evacuated by the second turbo molecular pump stage 20C, the first turbo molecular pump stage 20B and the backing pump 20A via the secondary interstage port 100. Accordingly, the pressure within the third chamber 60 is lower than the pressure within the second chamber 50 and the pressure in the second chamber 50 is lower than the pressure in the first chamber 40.

In this embodiment, apertures are provided (not shown) between the first chamber 40 and the second chamber 50, as well as between the second chamber 50 and the third chamber 60. This allows the sample, once in a gaseous or ionised state, to flow from the first chamber 40 to the third chamber 60, via the second chamber 50, as illustrated by the arrows in FIG. 1A. When the vacuum chamber module 10 is used by, for example, a mass spectrometer, this enables equipment to be placed within the first chamber 40 to cause the sample to become gaseous or ionised if it is not already. Also, analyser equipment placed can be placed in the second chamber 50 (such as charged rods to generate an electromagnetic field) to control which particles pass through the second chamber 50 and into the third chamber 60. The third chamber 60 can then be provided with detection equipment which detects the particles present within the third chamber 60.

As can be seen, by placing the second chamber 50 and the third chamber side by side, with ports positioned to access the different stages of the vacuum pump 20, a compact vacuum chamber module 10 is provided. It will be appreciated that where further vacuum pump stages are provided, further chambers can also be provided which extend circumferentially around the pump chamber 30, sharing common walls with each other and/or with the second chamber 50 or the third chamber 60, each having their own port for fluid communication with an appropriate stage of the vacuum pump.

Vacuum Chamber Module—2$^{nd}$ Embodiment

Figure 2A:
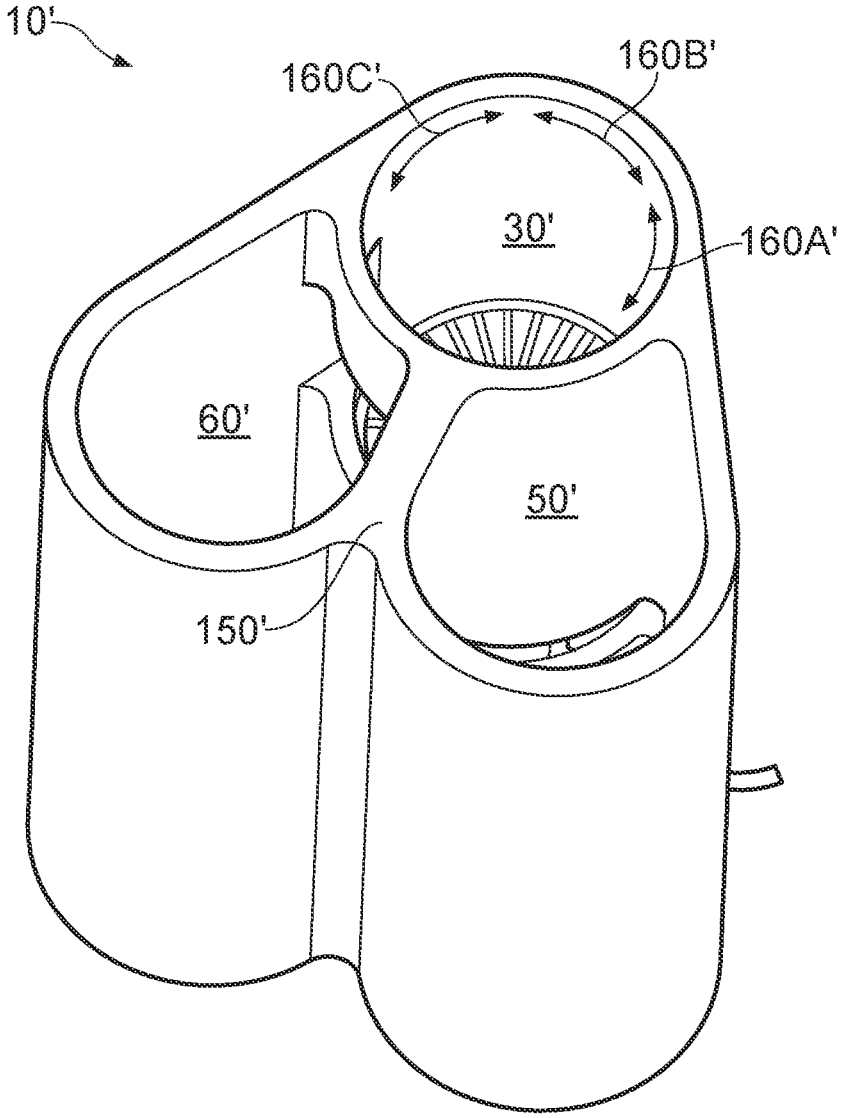
FIG. 2A is a perspective view of a main component of a vacuum chamber according to one embodiment incorporating a vacuum pump.
Figure 2B:
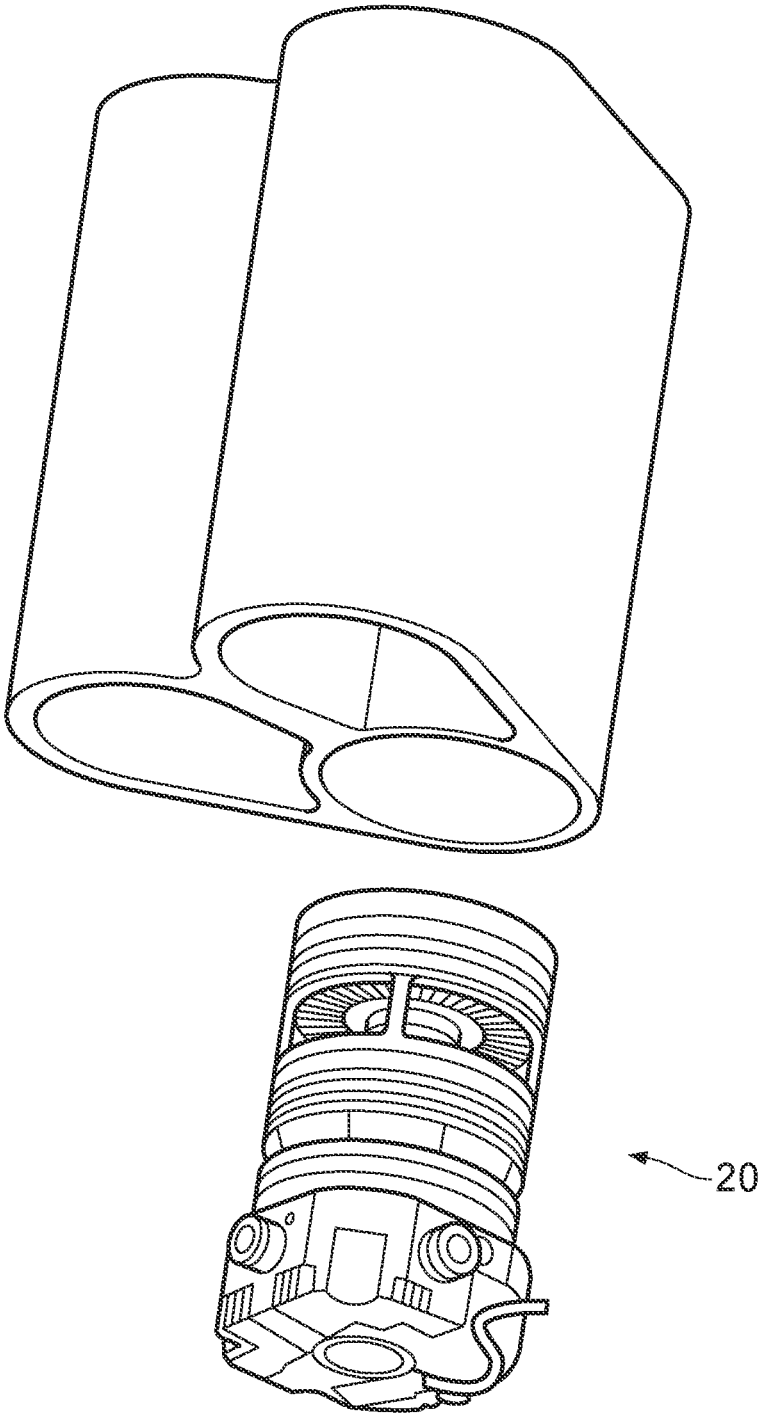
FIG. 2B a perspective view of the main component of the vacuum chamber with the vacuum pump removed.
Figure 2C:
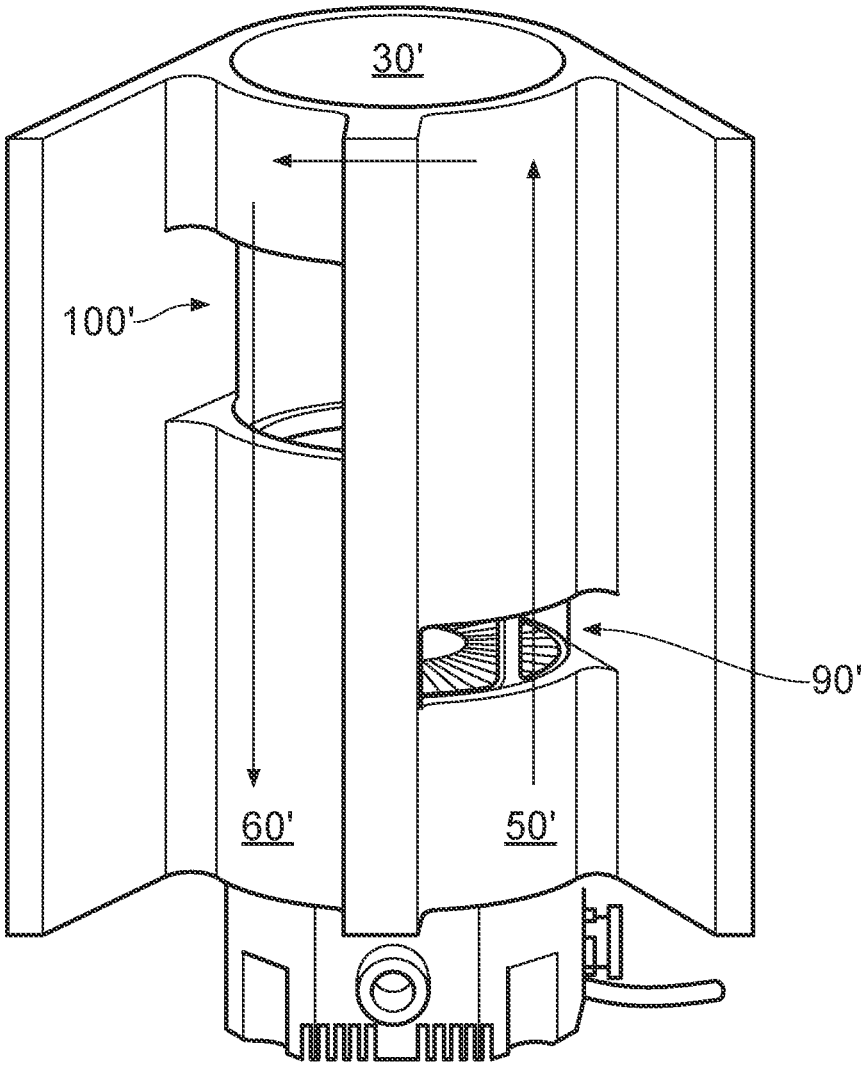
FIG. 2C is a sectional perspective view of the main component of the vacuum chamber incorporating the vacuum pump.

FIGS. 2A to 2C illustrates a vacuum chamber module 10' according to one embodiment. This embodiment is extruded rather than being cast. End plates (not shown) are fitted onto longitudinal ends of the chambers to enclose the chambers, but these have been omitted to improve clarity. As can be seen, the vacuum pump 20 occupies a cylindrical pump chamber 30'. A second chamber 50' and a third chamber 60' is provided. The second chamber 60' has a primary interstage port 90', while the third chamber 60' has a secondary interstage port 100'. Although just two chambers are shown, it will be appreciated that further chambers may be provided, each of which extends at least partially circumferentially around the pump chamber 30'. For example, a first chamber may be provided adjacent the second chamber 50', which shares a common wall with the second chamber 50'. Typically, the vacuum pump 20 would then be received further within the pump chamber 30' with a port provided in the pump chamber 30' to couple the first chamber with the inlet port 80. It can be seen that, for example, at least a further three chambers may be provided extending from the arc portions 160A', 160B', 160C' of the pump chamber 30'. In which case, the vacuum pump 20 would need a further three stages to enable each of the chambers to be evacuated to different pressures.

Vacuum Chamber Module—3$^{rd}$ Embodiment

Figure 3A:
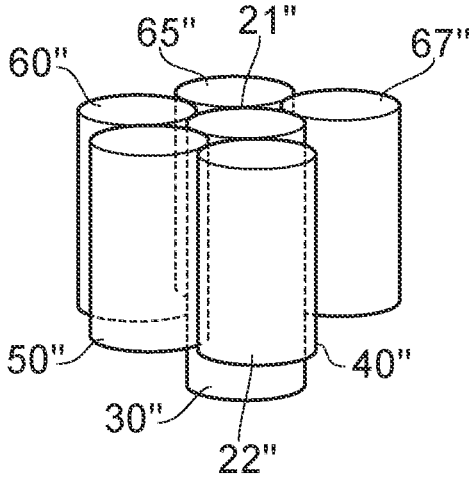
FIG. 3A is a schematic illustration of a vacuum chamber according to one embodiment.
Figure 3B:
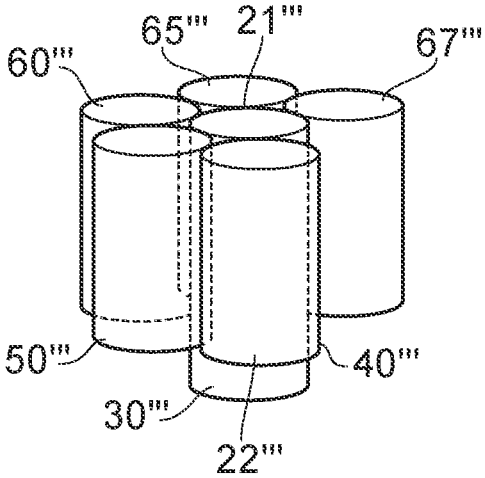
FIG. 3B is a schematic illustration of a vacuum chamber according to one embodiment.

FIGS. 3A and 3B illustrate schematically a vacuum chamber module 10" according to one embodiment. This embodiment utilises more than one vacuum pump. In this embodiment, two vacuum pumps 21", 22" are provided, positioned at different locations (in this embodiment, at either ends) of the pump chamber 30". Five vacuum chambers 40", 50", 60". 65", 67" are provided which are positioned around the pump chamber 30". It will be appreciated that the detailed implementation of the vacuum chamber module 10" can be arranged as described with reference to FIGS. 1A to 1F or FIGS. 2A to 2C above. Likewise, it will be appreciated that the embodiments described with reference to FIGS. 1A to 1F or FIGS. 2A to 2C above can be implemented using the cylindrical arrangement described with reference to FIGS. 3A to 3B. In any event, as shown in FIG. 3A, vacuum pump 21" is arranged to pump vacuum chambers 60", 65", 67" by providing suitably located ports in the shared wall between the vacuum chambers 60", 65", 67" and the pump chamber 30". Vacuum pump 22" is arranged to pump vacuum chambers 40", 50" by providing suitably located ports in the shared wall between the vacuum chambers 40", 50" and the pump chamber 30".

Turning now to FIG. 3B, vacuum pump 21''' is arranged to pump vacuum chambers 60''', 65''', 67''' by providing suitably located ports in the shared wall between the vacuum chambers 60''', 65''', 67''' and the pump chamber 30'''. Vacuum pump 22''' is arranged to pump vacuum chambers 40''', 50''', 67''' by providing suitably located ports in the shared wall between the vacuum chambers 40''', 50''', 67''' and the pump chamber 30'''.

Hence, it can be seen that a second or further pump can also share the same pump chamber but be positioned at the opposite end and connected to different vacuum chambers as required. This allows one pump embedded in the vacuum pump chamber to pump on some of the vacuum chambers and a second pump fitted into the opposite end to pump other of the vacuum chambers. It is also possible that they could both pump together on one or more shared vacuum chambers to boost pumping speed and hence vacuum performance if needed.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum chamber module, comprising:

a pump wall defining a recess shaped to receive a multi-stage vacuum pump;

a plurality of vacuum chambers, each vacuum chamber being configured to be pumped using a different respective number of stages of the multi-stage vacuum pump, each vacuum chamber being defined at least partially by a portion of said pump wall, each vacuum chamber having a respective pumping port for fluid communication with an inlet of a respective stage of said multi-stage vacuum pump, at least a portion of the pumping port between one vacuum chamber of the plurality of vacuum chambers and an inlet of a first stage of said multi-stage vacuum pump being angularly and longitudinally offset from the pumping port between a second vacuum chamber of the plurality of vacuum chambers and an inlet of a second stage of said multi-stage vacuum pump and a portion of the one vacuum chamber and a portion of the second vacuum chamber extending along a common portion of a longitudinal axis at a common radius from a center of the recess.

2. The vacuum chamber module of claim 1, wherein said pump wall is arced and the ports extend along respective portions of the arc of said pump wall.

3. The vacuum chamber module of claim 1, wherein an entirety of the pumping port of the one vacuum chamber is angularly offset from the pumping port of the second vacuum chamber.

4. The vacuum chamber module of claim 1, wherein the one vacuum chamber and the second vacuum chamber share a common dividing wall extending along said common portion of said longitudinal axis.

5. The vacuum chamber module of claim 1, wherein said pump wall defines a pump chamber shaped to receive said multi-stage vacuum pump.

6. The vacuum chamber module of claim 1, wherein said pump wall surrounds said multi-stage vacuum pump.

7. The vacuum chamber module of claim 1, wherein said pump wall is cylindrical.

8. The vacuum chamber module of claim 1, wherein the one vacuum chamber has a pair of vacuum chamber walls extending radially from said pump wall.

9. The vacuum chamber module of claim 8, wherein said one vacuum chamber is further defined by a circumferential wall extending circumferentially and joining said pair of vacuum chamber walls.

10. The vacuum chamber module of claim 1, wherein said vacuum chambers extend radially from said pump chamber and are positioned circumferentially around said pump chamber.

11. The vacuum chamber module of claim 1, wherein an inter-chamber aperture is configured for fluid communication between the one vacuum chamber and the second vacuum chamber.

12. The vacuum chamber module of claim 1, wherein said pump wall defines a recess shaped to receive at least one further vacuum pump.

13. The vacuum chamber module of claim 12, wherein each vacuum chamber has at least one pumping port located on said pump wall for fluid communication with at least one of said multi-stage vacuum pump and said at least one further vacuum pump.

* * * * *